United States Patent [19]

Svy

[11] Patent Number: 4,772,891

[45] Date of Patent: Sep. 20, 1988

[54] BROADBAND DUAL POLARIZED RADIATOR FOR SURFACE WAVE TRANSMISSION LINE

[75] Inventor: Kosal Svy, Kent, Wash.

[73] Assignee: The Boeing Company, Seattle, Wash.

[21] Appl. No.: 119,179

[22] Filed: Nov. 10, 1987

[51] Int. Cl.[4] ..... H01Q 1/30

[52] U.S. Cl. ..... 343/707; 343/785; 343/792.5

[58] Field of Search ..... 343/707, 785, 792.5, 343/832, 898, 905

[56] References Cited

U.S. PATENT DOCUMENTS 3,110,030 11/1963 Cole ..... 343/792.5

3,349,404 10/1967 Copeland et al. ..... 343/792.5

4,556,889 12/1985 Buehler ..... 343/707

*Primary Examiner*—William L. Sikes

*Assistant Examiner*—Hoanganh Le

*Attorney, Agent, or Firm*—Christensen, O'Connor, Johnson & Kindness

[57] ABSTRACT

Disclosed is a conically shaped reflector for producing dual polarized electromagnetic radiation in a surface wave transmission system. The reflector includes a circular conductive region that covers the apex of the conical reflector with the surface wave transmission line being joined to the center of the circular conductive region. Extending outwardly from equally spaced apart positions along the circumference of the circular conductive region are four conductive log-periodic arms.

6 Claims, 3 Drawing Sheets

BROADBAND DUAL POLARIZED RADIATOR FOR SURFACE WAVE TRANSMISSION LINE

BACKGROUND OF THE INVENTION

This invention relates to radiation of RF energy from a surface wave transmission line. More specifically, this invention relates to an RF transmission and radiation system in which a reflector that is connected to the end of the surface wave transmission line exhibits dual polarization over a broadband of frequencies.

As is known in the art, RF electromagnetic energy will propagate along a single conductor that is configured or treated to concentrate and confine the electromagnetic energy to a cylindrical volume that coaxially surrounds the conductor. This type of transmission line is known as a surface wave transmission line, a Goubau line or a G-line. In the more commonly known surface wave transmission lines, a conductor is surrounded by a coating of low-loss dielectric. Since the phase velocity of the electromagnetic energy that propagates through the dielectric coating is less than the free space phase velocity of the propagating signal, substantially all of the electromagnetic energy is confined to the dielectric and a cylindrical volume of space that concentrically surrounds the dielectric coating. Other techniques for suitably decreasing the phase velocity of the propagating signal also are known. For example, crimping an uncoated wire or machining thread-like grooves in the wire surface will cause a reduction in phase velocity in signals traveling along the wire, thereby causing the uncoated wire to act as a surface wave transmission line.

Since surface wave transmission lines provide a highly efficient transmission medium (low-loss operation) and will support electromagnetic wave propagation over a wide frequency range (broadband operation), application is found in various situations in which an environmental situation can accommodate the unique properties of a traveling surface wave. One such application is a surface wave transmission and radiation system wherein a wire (surface wave transmission line) is towed by an aircraft and one or more radiators that are located at or near the distal end of the wire cause the propagating surface wave energy to be detached from the wire (i.e., radiated into space). Examples of this type of aircraft-surface wave transmission and radiation system are disclosed in copending U.S. Pat. No. 4,743,916, Ser. No. 813,049, filed Dec. 24, 1985, by G. A. Bengeult and entitled "Method and Apparatus For Proportional RF Radiation From Surface Wave Transmission Line"; and in my copending U.S. patent application, which is being filed on even date with this patent application, and is entitled "Apparatus For Circularly Polarized Radiation From Surface Wave Transmission Line." In the systems disclosed in both of the referenced patent applications, an electromagnetic wave that is to propagate along the surface wave transmission line is coupled to the transmission line by a rearwardly facing horn-like surface wave "launcher." The launcher, in effect, serves as a transition between the surface wave transmission line and a coaxial cable or waveguide that serves as a feed line that interconnects the surface wave transmission line with the aircraft RF transmitter or transceiver.

In the radiation system disclosed in the referenced patent application by Bengeult, a series of two or more electrically conductive radiating elements that are spaced apart by a distance greater than one wavelength (relative to the RF electromagnetic energy that propagates along the surface wave transmission line) are configured in a manner that causes radiation of the RF electromagnetic energy that impinges on the radiator or radiators. When viewed from the far field, the result is that each radiator appears to be a horizontally polarized separate source of radiation.

In my referenced patent application, an arrangement of two radiators that are spaced apart from one another are configured and arranged to produce circularly polarized radiation. To attain this result, the forwardmost radiator includes an annular conductive region that surrounds the surface wave transmission line with a pair of spiral antenna arms extending outwardly along the surface of the radiator from oppositely disposed positions on the outer boundary of the annular conductive region. The second radiator, which is located at the terminus of the surface wave transmission line, includes a circular conductive region to which the surface wave transmission line is connected and further includes a pair of spiral antenna arms that extend outwardly along the surface of the radiator. The annular opening in the forwardmost radiator is dimensioned so that one-half of the incident surface wave energy is radiated by the forwardmost radiator and the remaining one-half of the electromagnetic energy propagates through the circular opening of the annular conductive region and is radiated by the second radiator. The orientation between the forwardmost and second radiators is established both with respect to axial distance between the radiators and the spatial position of the inner ends of the spiral antenna arms to cause the individual signals radiated by the two radiators to combine in a manner that results in the desired far field circular polarization.

Because the system disclosed in my referenced patent application provides circularly polarized electromagnetic radiation, that system may be advantageously employed in situations in which the radiated electromagnetic energy that is to be received by one or more antenna arrangements are of unknown polarization. Even though such a system provides precise and uniform circularly polarized radiation that will yield near optimal performance with receiving antennas of any polarization, a need exists for other surface wave radiation devices that produce electromagnetic energy that is polarized in more than one direction. Specifically, in some situations, the radiated electromagnetic energy may be received by antennas that exhibit either vertical polarization or horizontal polarization, but do not exhibit polarization that is angularly oriented with respect to the vertical or horizontal axes. In such a situation, dual polarization of the transmitted electromagnetic energy (vertical and horizontal) will provide substantially the same result as circularly polarized radiation. In addition, dual polarized radiation will often suffice even through the receiving antenna may be polarized in any direction. That is, although receiving antennas that are not horizontally or vertically polarized will not generate as great a signal when a dual polarized transmitting arrangement is utilized, the off-axes loss of signal may not seriously affect overall system operation. The acceptance of dual polarized radiation instead of circularly polarized radiation can be further enhanced in the event that the radiating apparatus is simpler in structure and more economical to manufacture than the apparatus that provides the circularly polarized electromagnetic radiation.

Accordingly, it is an object of this invention to provide an arrangement for radiating dual polarized electromagnetic energy from the terminus of a surface wave transmission line.

It is a further object of this invention to achieve dual polarized radiation in a surface wave transmission and radiation system in a manner that lends itself to easy and economical fabrication.

SUMMARY OF THE INVENTION

These and other objects are achieved in accordance with this invention by a single radiator ("reflector") that is attached to the end of a surface wave transmission line with the reflector smoothly increasing in cross-sectional area relative to the direction in which electromagnetic energy propagates along the surface wave transmission line. The surface of the reflector that faces the surface wave transmission line includes a centrally located electrically conductive region, with the terminus of the surface wave transmission line being joined to the midpoint of the centrally located conductive region. Extending outwardly from the centrally located conductive region and along the surface of the reflector are a plurality of electrically conductive regions that are shaped to form a pattern of equally spaced apart log-periodic conductive elements. That is, each such conductive region includes a radially extending conductive strip that increases in width relative to distance measured away from the centrally located conductive region. Extending circumferentially from each radially extending strip are a plurality of spaced apart circumferential strips (or "fins") that are formed so that the size (length and width) and spacing of the circumferentially extending strips increase from a minimum value to a maximum value relative to the distance by which the circumferentially extending strips are located from the centrally located conductive region.

In the currently preferred embodiment of the invention, broadband dual polarization is achieved by utilizing four log-periodic conductive elements that extend from equally spaced apart positions along the outer circumference of a circular central conductive region. Each log-periodic conductive element includes three circumferentially extending arms with the innermost and outermost arms extending about the surface of the conical reflector in one direction and the centermost arm extending in the opposite direction.

In these currently preferred embodiments, the terminal edge of the cone-shaped reflector is dimensioned so that the radius thereof is on the order of the radius of the energy tube that is associated with the electromagnetic energy that travels along the surface wave transmission line. Cone angle is selected to provide the desired directional characteristics and the radius of the centrally located circular conductive region is established substantially equal to one-quarter wavelength at the center frequency of the desired operating band width.

BRIEF DESCRIPTION OF THE DRAWING

Other features will become apparent from the following description which is given as an example and which is illustrated by the accompanying drawing in which.

DETAILED DESCRIPTION

Figure 1:
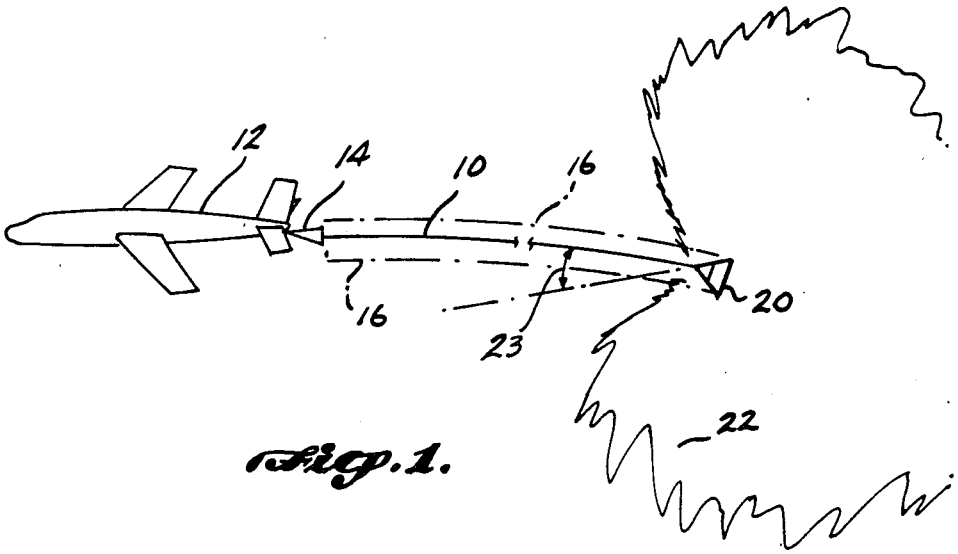
FIG. 1 is a schematic view of an RF transmission and radiation system of the type that can advantageously employ the invention.

With reference to FIG. 1, in one type of RF transmission and radiation system that can advantageously employ the invention, a surface wave transmission line 10 is extended rearwardly from an aircraft 12. In this arrangement, an RF transmitter that is located within aircraft 12 (not shown in FIG. 1) couples the electromagnetic energy to be radiated by the system to a launcher 14 which is located at the forward end of surface wave transmission line 10 (i.e., adjacent the tail section of the aircraft 12). Launcher 14 serves as an interface between the transmission medium of the RF aircraft transmission system (e.g., coaxial cable or waveguide) and the surface wave transmission line. Various arrangements are known in the art that can be employed as launcher 14 of FIG. 1. For example, one such device is disclosed and claimed in copending U.S. patent application, Ser. No. 913,774, filed Sept. 30, 1986, now U.S. Pat. No. 4,730,172, by G. A. Bengeult, which is entitled "Launcher For Surface Wave Transmission Lines," and is assigned to the assignee of this invention.

Regardless of the exact configuration of launcher 14, the launcher causes RF energy supplied by the aircraft transmission system to be coupled onto the surface wave transmission line 10 as a traveling "bundle" of wave energy. In this regard, as is known to those familiar with surface wave transmission lines, coating the outer surface of a conductive wire with low-loss dielectric machining grooves and/or crimping the wire establishes a transmission environment in which the phase velocity of the electromagnetic signal traveling along the wire is less than the free space phase velocity of that signal. This, in turn, confines the electromagnetic field to a cylindrical region in space ("energy tube"; indicated in FIGS. 1 and 2 by phantom lines 16) that concentrically surrounds the wire. As is indicated in FIG. 2 by the dashed arrows 18, the electric field vectors (E vectors) of the electromagnetic filed that surrounds the surface wave transmission line are perpendicular to the transmission line and extend radially between the outer diameter of the energy tube 16 and surface wave transmission line 10.

Mounted at the distal end of surface wave transmission line 10 of FIG. 1 is a radiator 20 of conical or other aerodynamically stable geometry. In systems previously developed by the assignee of this invention, radiator 20 includes either a single radiating element or a plurality of spaced apart radiating elements. For example, in one such arrangement, radiator 20 is conical, with the outer surface being formed of an electrically conductive material. In operation, the electromagnetic energy traveling along surface wave transmission line 10 impinges upon radiator 20 and is reflected therefrom so that the energy becomes detached from surface wave transmission line 10 to form a radiation pattern that is indicated in FIG. 1 by the region bounded by line 22. As is indicated in FIG. 1, the radiation pattern includes a substantially conical null region that is symmetrically disposed about transmission line 10 and extends forwardly toward aircraft 12, with the angle between surface wave transmission line 10 and the outer boundary of the null region being defined by an aspect angle 23.

When equipped with a radiator 20 of the above-described type, an RF surface wave transmission and radiation system such as that depicted in FIG. 1 produces a radiated electromagnetic field of predetermined polarization. In this regard, when the electromagnetic energy traveling within energy tube 16 impinges on a radiator having an electrical region that radially encompasses all or a major portion of the surface of the radiator, the electric field vectors associated with the radiated energy are substantially parallel to surface wave transmission line 10. Thus, the radiated field is polarized in the direction in which the surface wave transmission line extends. Since surface wave transmission line 10 in the system of FIG. 1 is substantially horizontal, it thus can be recognized that a horizontally polarized signal is radiated by the depicted system.

Figure 2:
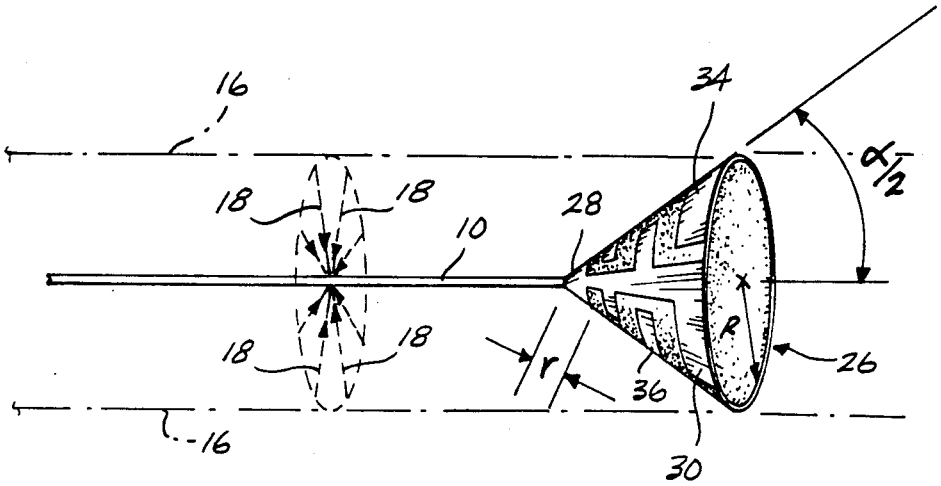
FIG. 2 is an isometric view of the distal end of a surface wave transmission line that is equipped with a dual polarized reflector that is constructed in accordance with this invention.
Figure 3:
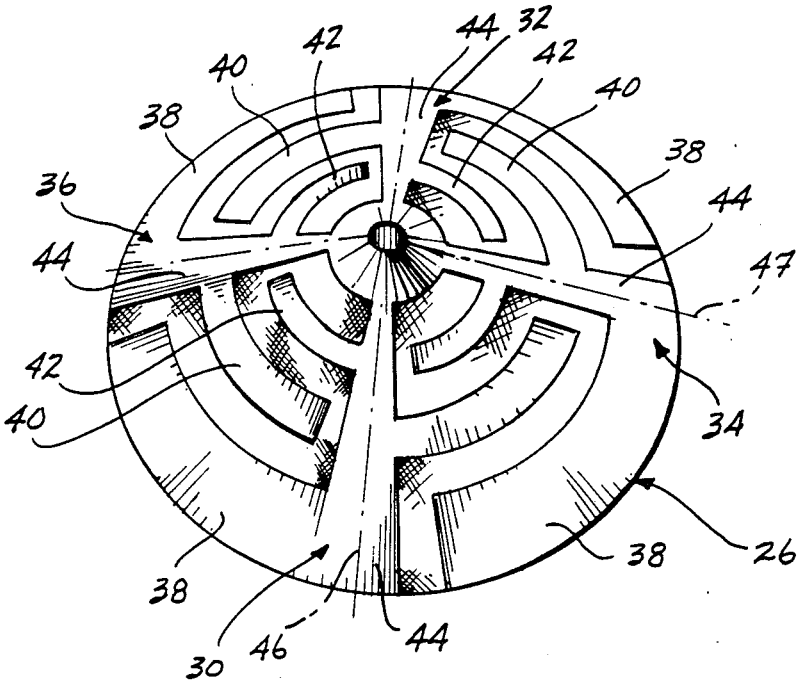
FIG. 3 is an isometric view of the dual polarized reflector of FIG. 2 which illustrates additional detail of the reflector.

The manner in which this invention is arranged to provide radiation from a surface wave transmission line that exhibits dual polarization (i.e., substantially equal horizontal and vertical radiation components), is illustrated in FIGS. 2 and 3. As is indicated in FIG. 2, a reflector 26 that is configured in accordance with the invention is affixed at the terminus of the surface wave transmission line 10 and is of smoothly increasing cross-sectional geometry. As is shown in both FIGS. 2 and 3, the currently preferred embodiment of the invention is conical in geometry with the radius of the aft end of the reflector, R, being commensurate with the radius of energy bundle 16 of the electromagnetic energy that travels along surface wave transmission line 10 and impinges upon reflector 26. As also is indicated in FIG. 2, conical reflector 26 exhibits a cone angle of $\alpha$, which can be established to control the radiation pattern produced by reflector 26. In this regard, an increase in cone angle $\alpha$ results in narrowing of the radiation pattern, which is indicated by 22 in FIG. 1. That is, as the cone angle $\alpha$ is increased, the resulting radiation pattern tends to more closely approximate a single lobe that extends rearwardly from reflector 26. Conversely, decreasing the cone angle results in a broader radiation lobe.

In accordance with the invention, reflector 26 can be formed from a block of material or, alternatively, can be a sheet of dielectric material that is formed into the desired conical configuration. In either case, the desired dual polarized reflection and radiation is attained by a conductive pattern that is formed in or on the surface of the reflector. More specifically, as is illustrated in both FIGS. 2 and 3, a circular conductive region 28 is formed at the apex of reflector 26 to define a small conductive cone that extends rearwardly from surface wave transmission line 10. As is best shown in FIG. 3, extending outwardly from equally spaced apart positions along the circumference of circular conductive region 28 are four electrically conductive arms 30, 32, 34 and 36.

Each arm 30, 32, 34 and 36 is configured in a manner similar to a conventional planar log-periodic antenna element. Specifically, in the embodiment of the invention depicted in FIGS. 2 and 3, each arm is identically configured and includes three spaced apart conductive fin regions 38, 40 and 42 that extend circumferentially from the boundary edges of an associated radially extending conductive strip 44. As is the case with more conventionally log-periodic devices, the length and width of the circumferentially extending fins 38, 40 and 42 increase relative to the distance between the apex of reflector 26 and that particular conductive fin in accordance with a predetermined logarithmic ratio. As also is the case with more conventionally arranged log-periodic radiators, the width of the strips 44 also increase in accordance with distance from the apex of radiator 26 and corresponding fins of oppositely disposed arms extend from opposite sides of diametrical axes (46 and 47 in FIG. 2 that pass through the conductive strips 44). That is, considering the pair of arms made up of arm 30 and arm 32, it can be seen that each conductive fin 38, 40 and 42 of arm 32 extends from the opposite edge of conductive strip 44 relative to the corresponding fin of conductive arm 30. This means that fin 40 of each conductive arm extends into the open region formed between fins 38 and 42 of an adjacent arm and that fin 42 of each arm extends into the open region defined between the outer boundary of circular conductive region 28 and fin 40 of an adjacent arm.

Although those familiar with log-periodic antenna structure will recognize that marked similarities exist between the above-described structure of reflector 26 and two log-periodic antennas that are spatially oriented for radiation of both horizontally and vertically polarized electromagnetic energy, it also will be recognized that such an arrangement constructed of two log-periodic antennas would not include a common conductive region (i.e, circular conductive region 28) that electrically connects all of the antenna elements. That is, as is known in the art, each arm of the more conventional log-periodic antenna arrangements is fed an electrical signal by means of a balanced feed line or other arrangement that ensures that the signals coupled to the antenna arms are of proper phase relationship.

Although the manner in which reflector 26 interacts with the electromagnetic energy that travels along a surface wave transmission line 10 and impinges on the reflector so that dual polarized radiation results are not fully understood, it has been found that a suitably configured reflector 26 will produce a radiated electromagnetic field having horizontal and vertically polarized components with the difference between the horizontal and vertical components being less than 1 decibel. In this regard, it has been found preferable to establish the radius, r, of circular conductive region 28 substantially equal to $\lambda_C/4$, where $\lambda_C$ represents the wavelength of the center frequency in the frequency band of interest. Further, as is indicated above, the radius of the base region of reflector 26 (R) preferably is approximately equal to the radius of the energy tube 18 that travels along surface wave transmission line 10. As also was indicated above, each conductive arm 30, 32, 34 and 36 is configured in a manner that causes fins 38, 40 and 42 to exhibit resonant frequencies that are spaced apart from one another over the bandwidth of interest with the resonant frequencies being equally spaced on a logarithmic scale.

Figure 4:
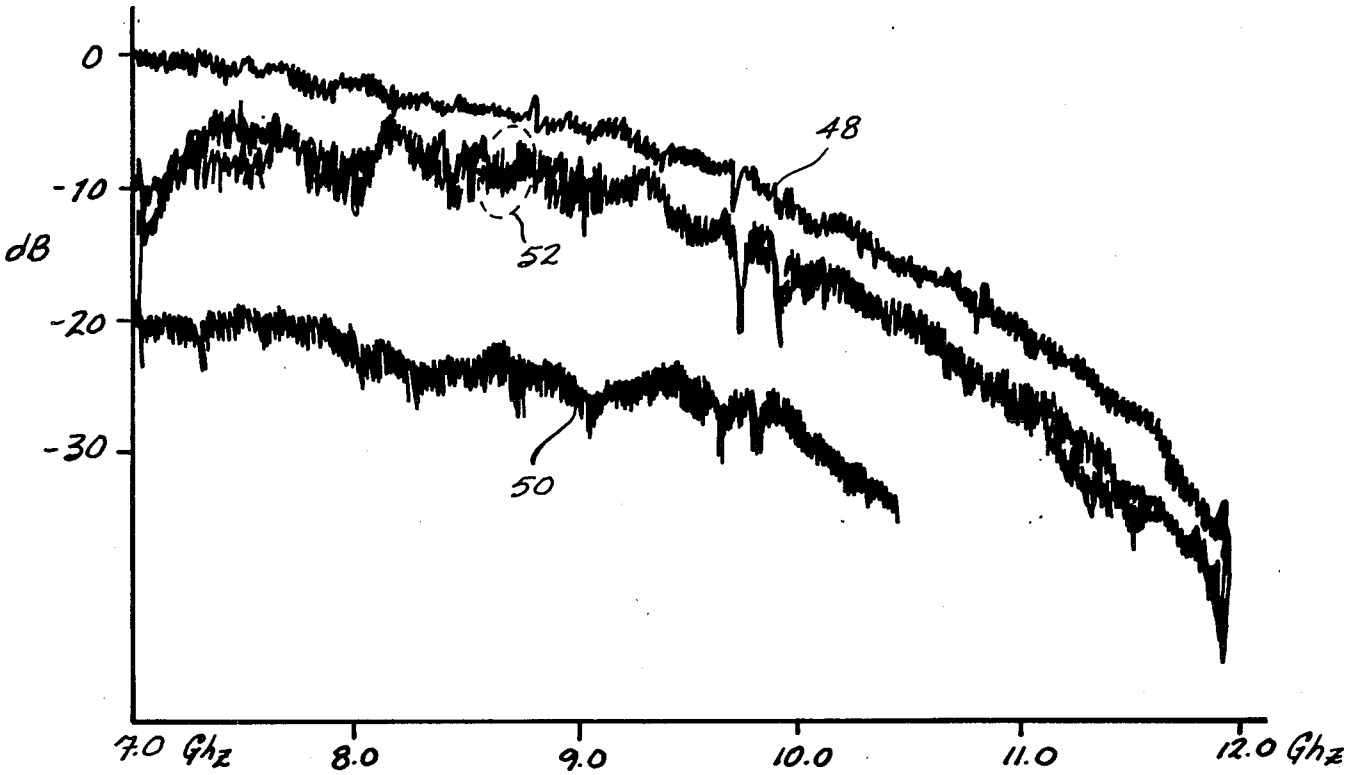
FIG. 4 is a graph that depicts the horizontal and vertical polarization components of one particular realization of the invention over a band of transmission frequencies.

The results that can be attained by the practice of the invention are illustrated in FIG. 4, which depicts the horizontal and vertical polarization components of a realization of the invention wherein the cone angle $\alpha$ is equal to 135° to produce an antenna pattern that provides aspect angles of 20–90°. To configure this particular realization for operation over a frequency range that extends between approximately 7 gigahertz and approximately 12 gigahertz, with the center frequency considered to be 9 gigahertz, the radius, r, of circular conductive region 28 is established at 3 inches (approximately 7.6 centimeters). Since the energy tube of the surface wave transmission system employing this particular realization was approximately 3 inches, the radius of the base of the conical reflector was established at 3 inches.

Referring now specifically to FIG. 4, it can be seen that the above discussed realization of the embodiment of the invention depicted in FIGS. 2 and 3 provides substantially equal horizontal and vertical polarization throughout the design bandwidth. More particularly, in FIG. 4, the upper trace 48 is a reference that indicates the total electrical field intensity provided by a prior art conical radiator having a conductive surface and a cone angle of 135°. Trace 50 is a second reference trace indicating signal levels 20 decibels below trace 48. The horizontally and vertically polarized components of the field provided by the above-identified embodiment of the invention are collectively indicated by 52. As can be observed in FIG. 4, these horizontal and vertical components are of substantially equal value throughout the frequency band. In this regard, the ratio between the actual values of the horizontal and vertical components for this realization of the invention do not exceed 1 decibel over the entire bandwidth.

While only particular embodiments have been disclosed, it will be readily apparent to persons skilled in the art that numerous changes and modifications can be made thereto, including the use of equivalent means and devices, without departing from the scope and spirit of the invention.

The embodiments of the invention in which an exclusive property or privilege is claimed are defined as follows:

1. A radio frequency transmission and radiation system comprising:

a surface wave transmission line adapted for transmission of an RF surface wave along said surface wave transmission line in a direction toward one terminus of said surface wave transmission line with the electromagnetic field of said RF surface wave being substantially confined to a substantially cylindrical energy bundle that concentrically surrounds said surface wave transmission line;

a reflector attached to said terminus of said surface wave transmission line, said reflector being of increasing cross-sectional geometry relative to the direction in which said RF surface wave travels along said surface wave transmission line, said reflector having an outer surface that includes an electrically conductive pattern, said electrically conductive pattern including an electrically conductive region that is centrally located on said surface of said reflector with said surface wave transmission line being attached to said electrically conductive central region and said electrically conductive central region exhibiting an area greater than the cross-sectional area of said surface wave transmission line, said electrically conductive pattern further including a plurality of outwardly extending electrically conductive arms that are equally spaced apart from one another and are electrically interconnected to said centrally located electrically conductive region, each of said arms being configured and dimensioned to form log-periodic elements.

2. The radio frequency transmission and radiation system of claim 1, wherein said plurality of electrically conductive arms consist of four log-periodic arms of substantially identical configuration.

3. The radio frequency transmission and radiation system of claim 2, wherein:

said centrally located electrically conductive region is circular; and each of said log-periodic arms includes a conductive strip radially extending from the outer circumference of said circular centrally located conductive region and further includes three conductive fin regions that extend circumferentially from spaced apart locations along said conductive strip with the fin regions located nearest and furthest from the circular centrally located electrically conductive region extending from a first edge of said conductive strip and the fin region that is located between said nearest and furthest fin region extending from the second edge of said conductive strip.

4. The radio frequency transmission and radiation system of claim 3, wherein said reflector is of substantially conical geometry.

5. The radio frequency transmission and radiation system of claim 4, wherein the diameter of said circular centrally located electrically conductive region is substantially equal to $\lambda_C/4$ where $\lambda_C$ represents the wavelength of the center frequency of a band of frequencies included in said RF surface wave.

6. The radio frequency transmission and radiation system of claim 5, wherein said reflector is of substantially conical geometry with the radius of the base being substantially equal to the radius of said substantially cylindrical energy bundle that concentrically surrounds said surface wave transmission line.

* * * * *